United States Patent [19]

Glass et al.

[11] 4,004,132

[45] Jan. 18, 1977

[54] CONVERTIBLE FLASHLIGHT-LANTERN

[75] Inventors: Marvin I. Glass, Chicago; Palmer J. Schoenfield, Evanston, both of Ill.

[73] Assignee: Marvin Glass & Associates, Chicago, Ill.

[22] Filed: Oct. 21, 1974

[21] Appl. No.: 516,582

Related U.S. Application Data

[62] Division of Ser. No. 333,745, Feb. 20, 1973.

[52] U.S. Cl. ..... 240/10.63; 240/6.4 R; 240/11; 240/22; 240/37

[51] Int. Cl.[2] ..... F21L 1/00; F21L 15/08; F21L 27/00

[58] Field of Search ..... 240/10.6 R, 10.63, 16, 240/22, 37, 11, 6.4 R, 10.66

[56] References Cited

UNITED STATES PATENTS

| | | | |
|---|---|---|---|
| 1,052,075 | 2/1913 | Martin | 240/6.4 R X |
| 1,132,091 | 3/1915 | Hellstrand et al. | 240/37 |
| 1,458,665 | 6/1923 | Stewart | 240/10.63 |
| 2,057,412 | 10/1936 | Boyd | 240/6.4 R X |
| 2,062,113 | 11/1936 | Baer et al. | 240/10.63 |
| 2,066,510 | 1/1937 | Younkman et al. | 240/10.63 |
| 2,137,881 | 11/1938 | Margulies | 240/6.4 R |
| 2,156,742 | 5/1939 | Shellabarger | 240/10.63 |
| 3,264,463 | 8/1966 | Bonner, Jr. | 240/6.4 R X |

*Primary Examiner*—Joseph F. Peters, Jr.
*Attorney, Agent, or Firm*—Coffee and Sweeney

[57] ABSTRACT

A comprehensive toy camping set which includes a convertible flashlight to lantern combination, a cooking utensil for holding cans of food and preventing the same from spilling, an electrically operated simulated camp fire, a toy hatchet which is convertible into an imprinting member for making markings such as an animal's paw in the ground, a toy knife having a whistle in the handle thereof for producing an animal sound or the like, a toy gun which has a light transmitting scope device for projecting images therefrom, an electrically operated warning device, and a novel camping pack construction. The camping pack has a piston and cylinder air pump for delivering air under pressure to inflate air mattresses or the like. A periscope device also is mounted on the pack for movement between a retracted position substantially within the pack to an upwardly protruding position permitting visual observation therethrough. A sound amplification unit, including a speaker, microphone, and electrical amplifier also is mounted on the pack. The pack has a substantially rigid framework with a planar, removable front cover on which a map, or the like, may be positioned and worked upon when the cover is opened. A battery operated light device also is mounted on the pack for facilitating visual observation of the map, as well as providing means for projecting light through the periscope for signalling purposes.

3 Claims, 16 Drawing Figures

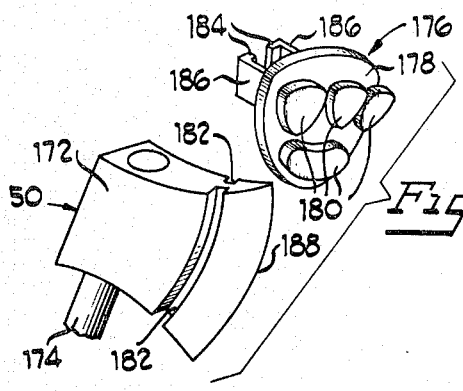
Fig 10
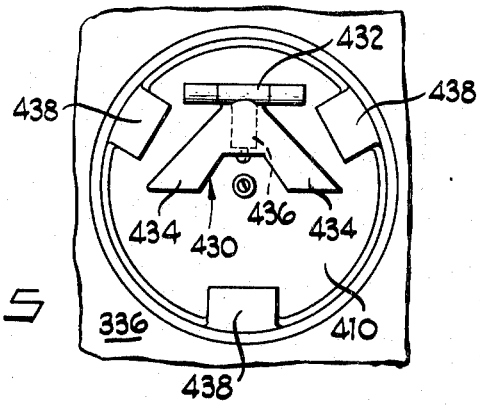
Fig 5
Fig 3
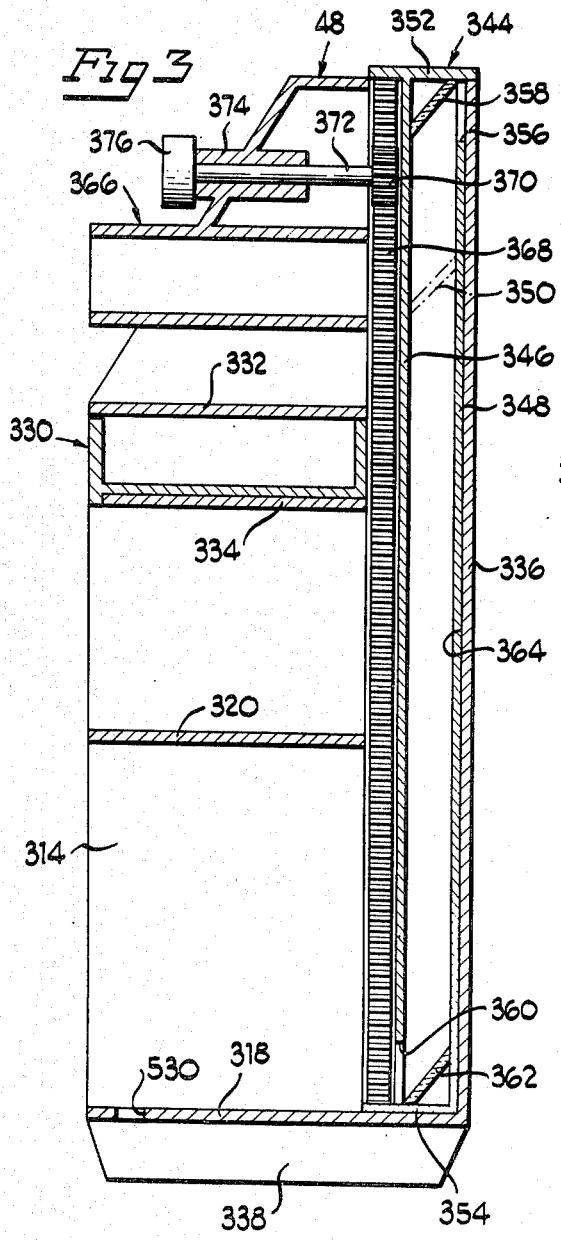
Fig 4
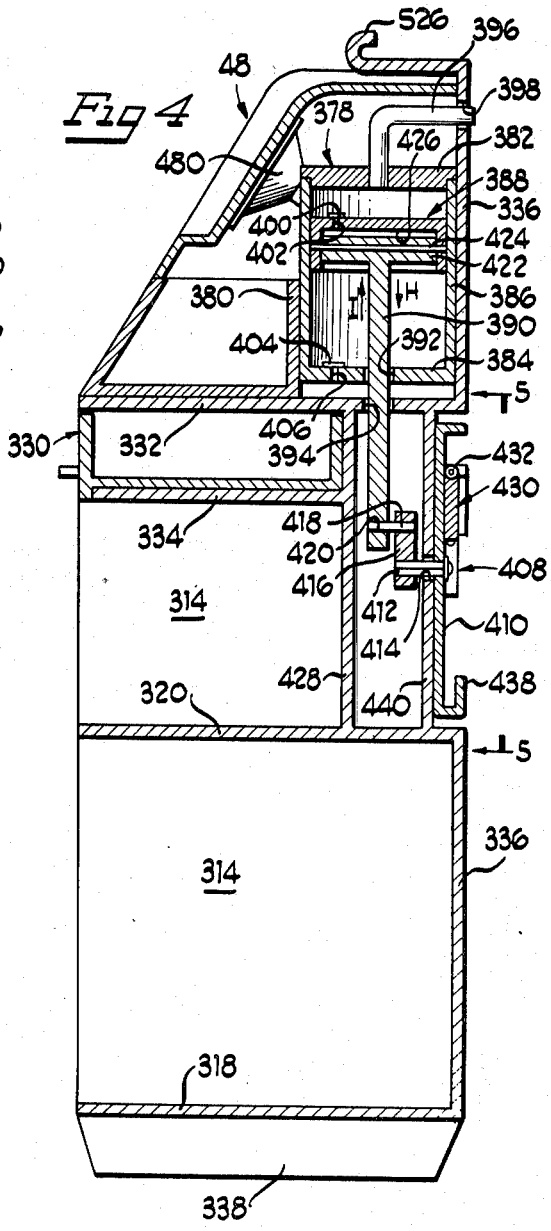

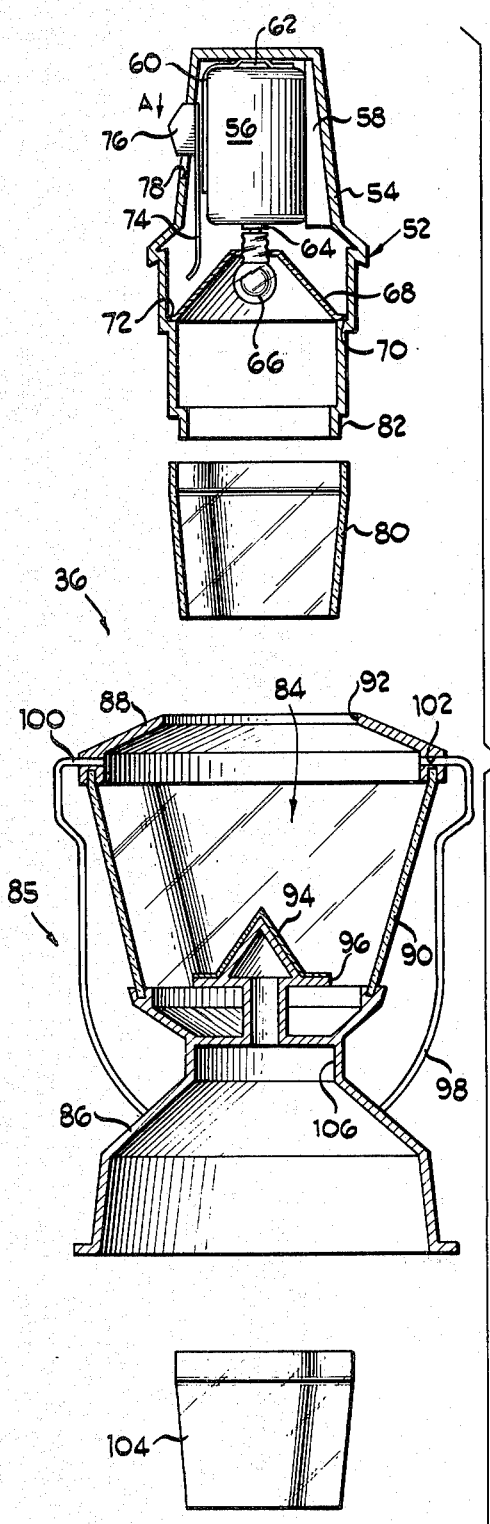
Fig 14
Fig 12
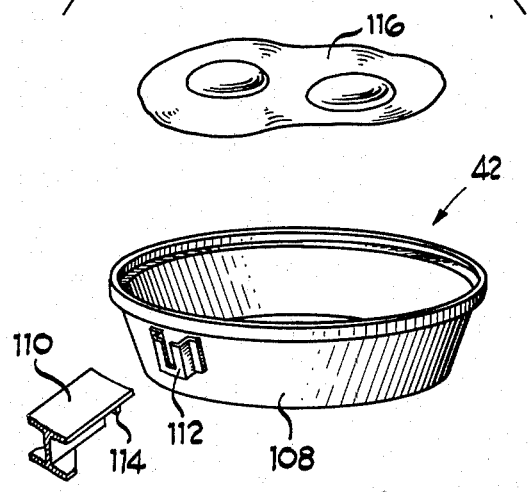
Fig 13
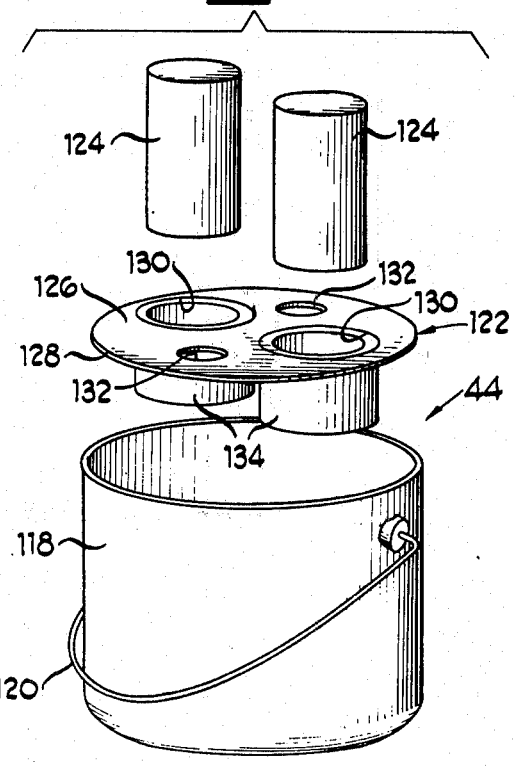

CONVERTIBLE FLASHLIGHT-LANTERN

CROSS REFERENCE TO OTHER APPLICATIONS

This is a division of co-pending application Ser. No. 333,745 filed Feb. 20, 1973.

BACKGROUND AND SUMMARY OF THE INVENTION

This invention relates to devices or implements particularly adapted for camping purposes. The invention is directed specifically to a complete comprehensive set of camping implements, both simulated and functional, particularly adapted for use by children.

The principal object, therefore, of the present invention is to provide a new and improved comprehensive set of devices and/or implements for use in actual or simulated camping surroundings.

One of the implements of the camping set of the present invention comprises a convertible flashlight to lantern combination. A typical elongated flashlight type lighting construction is provided for directing a beam of light therefrom generally in a singular direction. A lantern type conversion unit is provided with a receptacle for holding the flashlight in a vertical inverted position for directing the light beam downwardly therefrom. A conically shaped diffusion member is positioned beneath the flashlight in the path of the light beam for reflecting the light outwardly from the conversion unit 360° thereabout. The flashlight can be removed at any time from the conversion unit and used in its normal fashion.

Another implement comprises a cooking utensil which has a cooking pot for placing over a fire or other heating means, and a receptacle removably positioned within the pot for removably receiving and holding cans of food. The receptacle prevents the cans from moving laterally within the pot and also prevents the cans from tilting relative to the pot to prevent spillage of the food. The receptacle comprises a plate member having a marginal periphery which substantially mates with the inside walls of the pot and has tubular portions depending downwardly therefrom for spacing the plate member from the bottom of the pot. Apertures are formed in the plate member in registry with the tubular portions so that the tubular portions act as receptacles for holding cans of food therein.

Another device of the present invention comprises a simulated camp fire which has a substantially flat base with a plurality of upstanding simulated rocks about the marginal edge thereof. An electrical light means is mounted on top of the base and a somewhat cone shaped cover member is removably positionable on top of the base to camouflage the light means. The cover member is formed to simulate a burning camp fire and is at least translucent to permit at least some of the light rays from the light means to pass therethrough to simulate flames for the fire. A simulated cooking grill spans the top of the cover member and is positioned thereover by post members protruding upwardly from the base on opposite sides of the cover member. One of the simulated rocks is movably mounted and is operatively associated with on-off switch means to permit selective actuation of the light means.

A toy hatchet, axe, or the like, is provided and has a complementary imprint member removably positionable on the edged head of the hatchet for imprinting markings, such as an animal's paw, in the ground or the like.

A knife device is provided with a blade portion and a handle portion, with a whistle formed in the handle portion for producing an animal sound or the like. The whistle has an intake aperture in the end of the handle portion through which a user may blow, and an air exhaust aperture on the side of the handle portion for emitting the desired sound therefrom.

A toy gun also is provided with a simulated scope mounted on top of the gun for projecting light means therefrom, away from the gun generally in the longitudinal pointing direction of the gun barrel. A continuous film strip and lens system is mounted within the simulated scope for movement across the path of the light rays for projecting a plurality of changeable images, such as moving animals. A knob is provided on the side of the simulated scope for advancing the film, and an on-off switch for the light means is operatively associated with the trigger of the gun to turn the light means off when trigger is pulled.

A self-contained toy warning device also is provided with an upright housing having a base for supporting the same on the ground, a floor or the like. A spring biased plunger is mounted for reciprocating movement in the base of the warning device for movement to a retracted position when the housing is placed on the ground. When the housing is knocked over or lifted to move the base off of the ground, the plunger is spring biased to an outwardly projected position for actuating a sound signal to warn a child of the presence of a "disturbing" object.

A comprehensive camping pack construction also is provided. The hatchet is removably mountable onto the outside of the pack, along with a foldable chair and a foldable shovel. A piston and cylinder air pump means is mounted within the pack and has a manually manipulatable crank on the outside of the pack for operating the pump means for delivering air under pressure to inflate devices such as air mattresses or the like. An elongated periscope also is mounted on the pack for movement from a retracted position substantially within the pack to an upper position protruding substantially above the pack permitting visual observation through the periscope through an observation window at the lower end thereof. The periscope is moved by a rack and pinion arrangement, with the pinion being rotatable by a manually manipulatable knob exposed for manipulation on the pack. Light means is removably mounted on the pack for positioning in front of the window to project light through the periscope for signalling purposes.

The pack also has a sound amplification unit mounted thereon, including a speaker on the end of an elongated cord, a microphone and an electrical amplifier electrically connected between the speaker and the microphone. The pack has a rigid substantially planar front cover for supporting a map or the like. The aforesaid removable light means is usable for facilitating visual observation of the map. The rigid cover is removably mounted on the pack of providing a separate support means for the map remote from the pack. The pack also has separate individual compartments for receiving the cooking utensil, knife and various other supplies or equipment.

Other objects, features and advantages of the invention will be apparent from the following detailed description taken in connection with the accompanying drawings.

DESCRIPTION OF THE DRAWINGS

FIG. 3 is a vertical section taken generally along the line 3—3 of FIG. 2;

FIG. 4 is a vertical section taken generally along the line 4—4 of FIG. 2;

FIG. 5 is a partial rear elevational view taken generally in the direction of line 5—5 in FIG. 4 to show the crank handle for the air pump means;

FIG. 10 is a perspective view of the combination hatchet and imprint member of the present invention, with the handle portion of the hatchet broken away;

FIG. 12 is a perspective view of a pan type cooking utensil with a removable handle, the handle being broken away;

FIG. 13 is an exploded perspective view of the pot type cooking utensil of the present invention for receiving and holding cans of food;

FIG. 14 is an exploded vertical sectional view of the convertible flashlight to lantern combination of the present invention;

DETAILED DESCRIPTION OF THE INVENTION

Figure 1:
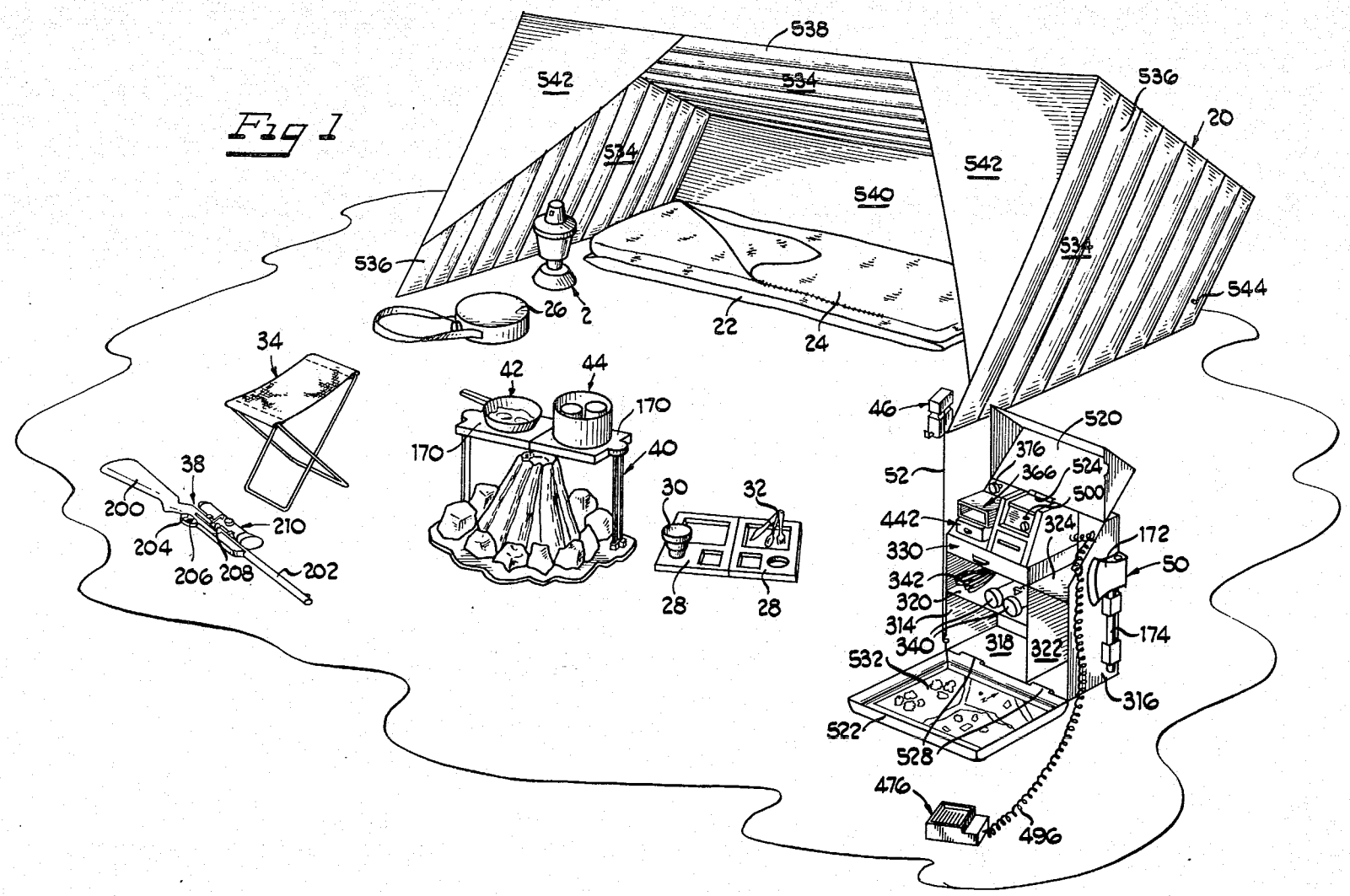
FIG. 1 is a perspective environmental layout of part of the comprehensive camping set of the present invention.

Referring to the drawings in greater detail, and first to FIG. 1, certain items of the camping set of the present invention are shown in sort of an environmental setting. Those devices shown include an inflatable tent, generally designated 20, an inflatable air mattress 22, a sleeping bag 24, a canteen 26, a pair of eating trays 28 having a cup 30 and eating utensils 32 thereon, and a foldable chair, generally designated 34. A convertible flashlight to lantern combination of the present invention is shown generally designated 36. A light projecting scope and rifle combination of the present invention is shown generally designated 38. A simulated camp fire of the present invention is shown generally designated 40, with cooking utensils, generally designated 42 and 44 positioned on a grill portion thereof. A warning device of the present invention is shown generally designated 46. A camping pack of the present invention is shown generally designated 48, with a toy hatchet, generally designated 50, removably mounted thereon. A trip string 52 is tied between the warning device 46 and camping pack 48.

Turning next to FIG. 14, the convertible flashlight to lantern combination 36 is shown in an exploded sectional view. The combination includes a flashlight type lighting construction, generally designated 52, which includes a unitary housing 54 within which is mounted at least one battery 56. The battery is sandwiched between an interior elongated boss 58 and an electrically conductive bracket 60, the bracket making electric connection with one end of the battery, as at 62. The opposite end of the battery is engaged (at 64) with the base of a typical threaded flashlight lightbulb 66. The lightbulb is threaded into a generally conical conductive reflector 68 which has an outer marginal flange 70 abutting against a shoulder 72 on the inside of the flashlight housing 54. a spring leaf type switch contact 74 is secured to a manually manipulatable button 76 which is exposed through an aperture 78 in the housing 54. When the button 76 is moved in the direction of arrow A, the contact leaf 74 will make contact with the conductive battery bracket 60 and the conductive reflector 68 to complete a circuit and energize the lightbulb 66 through the battery 56. A translucent or transparent lens member 80 is removably snap fit over a reduced diameter end portion 82 at the front of the flashlight housing 54.

The convertible flashlight to lantern combination 36 further includes a lantern-type conversion unit, generally designated 85, which includes a base structure having a receptacle, generally designated 84, for removably receiving and holding the flashlight 52 with the beam of light from the flashlight directed generally downwardly when the conversion unit is held in its normal upright position. The conversion unit includes a lower base portion 86 and an upper receptacle portion 88 which are connected by means of a generally hollow somewhat tapered portion 90. The hollow tapered portion 90 is either translucent or transparent to permit light rays to pass therethrough. The upper receptacle portion 88 has a receptacle aperture 92 through which the flashlight 52 is insertable. The hollow tapered portion 90 surrounds a diffusion means in the form of a conical reflector 94 which has its apex facing upwardly so as to be positioned in the path of the light rays from the flashlight when it is positioned in the receptable aperture 92. The reflector diffuses or reflects the light outwardly 360° therefrom. When in proper postion, the lower end of the lens 80 fits about an upwardly standing shoulder means 96 within the conversion unit 85. A loop-type handle 98 has end portions 100 received in apertures 102 in the upper receptacle portion 88 for holding the unit, with or without the flashlight 52 positioned therein as one would hold a lantern. The loop-type handle 98 is of sufficient size to protrude upwardly beyond the top of the flashlight when positioned in the receptacle 84.

An alternate lens 104 is provided similar to the lens 80 and may be of a different color, such as red for emergency purposes, and is removably snap fit within a recess 106 on the underside of the lower base portion 86 of the conversion unit 85.

Thus, it is apparent that the combination shown in FIG. 14 not only provides a flashlight 52 for use during camping to direct a beam of light in a singular direction, but when the flashlight is positioned within the receptacle 84 of the conversion unit 85, the light is diffused outwardly 360° by means of the conical reflector 94.

FIGS. 12 and 13 show the cooking utensils 42 and 44, respectively. The cooking utensil 42 includes a pan-type portion 108 and a handle portion 110. The pan portion 108 has a key-slot type bracket 112 for receiving a complementary tongue 114 on the front of the handle 110. The pan is provided for typical usage such as frying eggs 116.

The utensil 44 includes a cooking pot portion 118 having a wire-type loop handle 120 secured to the sides thereof. A receptacle means, generally designated 122, is removably positionable within the pot 118 for removably receiving and holding cans of food 124 for preventing the cans from moving laterally within the pot as well as preventing tilting of the cans relative to the pot to prevent spillage of the food within the cans. The receptacle means 122 includes a generally flat plate portion 126 which has a peripheral edge 128 which substantially mates with the inside walls of the pot 118. The plate member 126 also has a pair of apertures 130 for receiving the cans of food 124 and a pair of apertures 132 through which a user's fingers may be inserted to position the receptacle means within the pot 118 or remove the same therefrom. A pair of tubular members 134 protrude downwardly from the plate member 126 for engaging the planar bottom wall (not shown) of the pot and spacing the plate member upwardly therefrom. In addition, the tubular portions 134 are in registry with the apertures 132 for receiving and holding the cans of food 124 and preventing the same from tilting within the pot.

Figure 2:
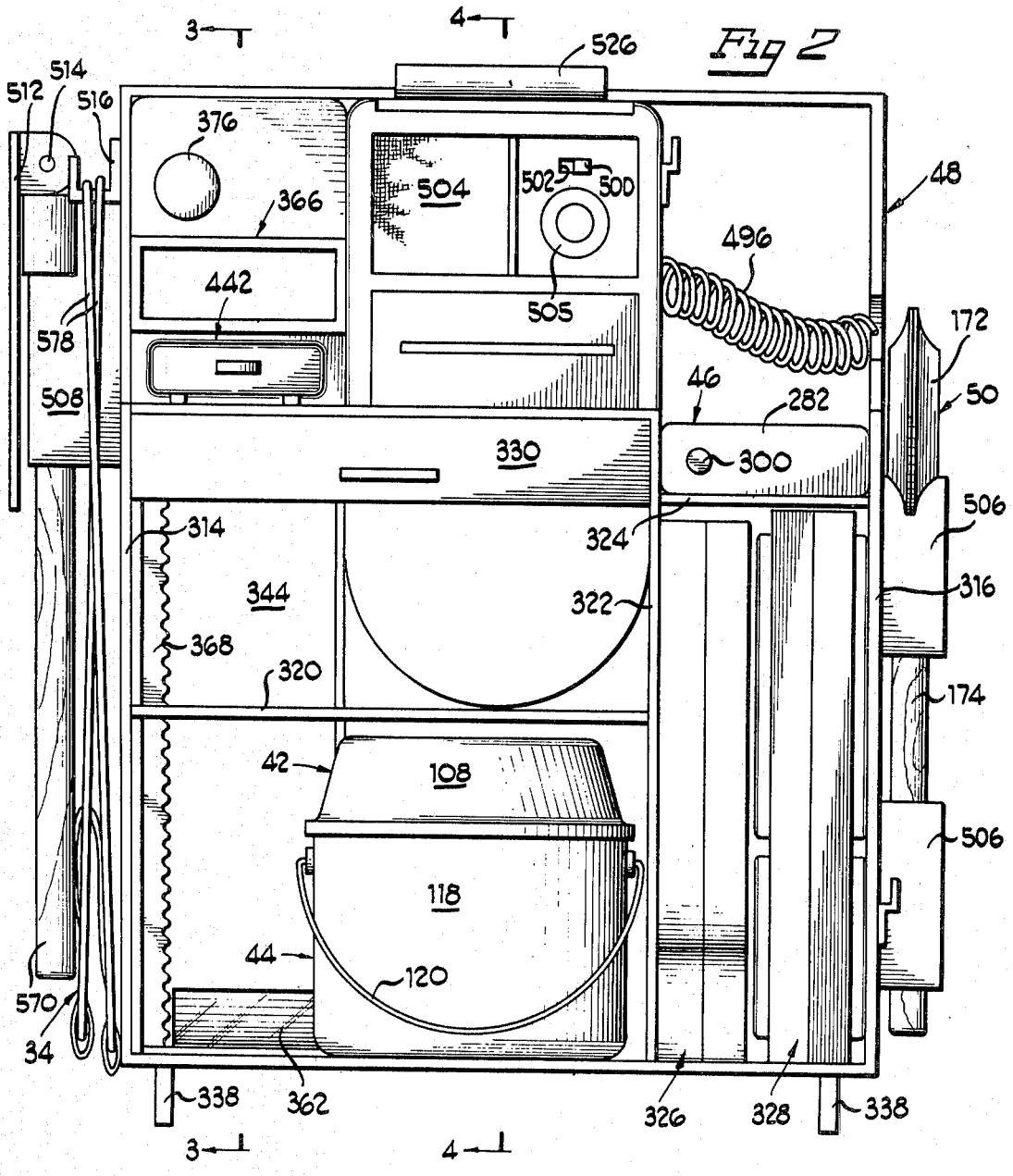
FIG. 2 is an enlarged front elevational view of the camping pack of the present invention, with the covers therefor removed.

The pan 42 is of a size to fit over and provide a cover for the pot 44, as seen in FIG. 2.

Figure 11:
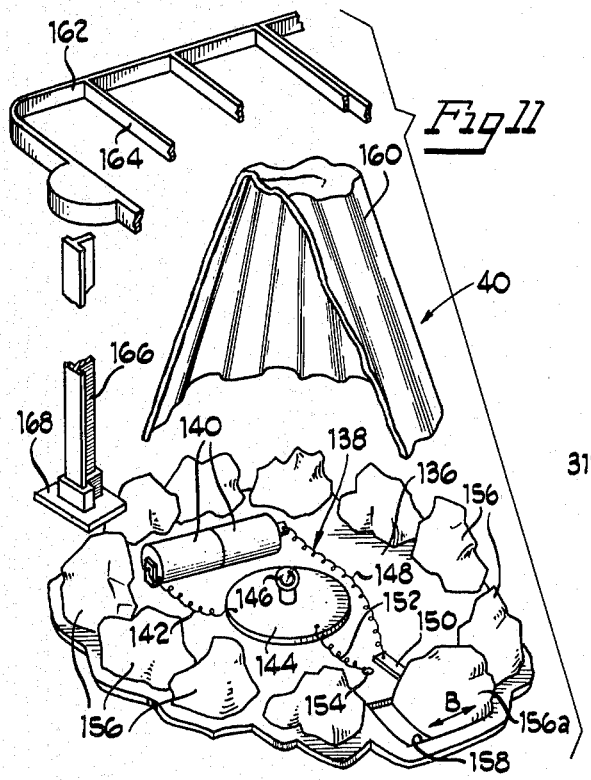
FIG. 11 is an exploded perspective view, partially broken away, of the simulated camp fire of the present invention.

FIG. 11 shows the electrically operated simulated camp fire 40 of the present invention. The simulated camp fire includes a generally flat base 136 for positioning on the ground, floor, or the like. An electrical light means, generally designated 138, is mounted on top of the base 136 for radiating light upwardly and outwardly therefrom. The light means includes a pair of batteries 140 connected by a wire 142 to a conductive mounting plate 144 for the lightbulb 146. The opposite end of the battery is connected by a wire 148 to a movable switch contact 150. The conductive mounting plate 144 is connected by a wire 152 to a fixed switch contact 154. A plurality of simulated rocks 156 are formed about the outer marginal periphery of the base 136. One of the rocks 156a is slidably received within an aperture 158 for reciprocal movement in the direction of double-headed arrow B. The movable rock **156*a* is secured to the movable switch contact 150 to move the same into and out of engagement with the fixed contact 152 to make or break the circuit to the lightbulb 146**.

The simulated camp fire 40 also includes a somewhat conically shaped hollow cover member 160 removably positionable on top of the base 136 within the simulated rocks 156 to camouflage the light means 138. The cover member 160 is formed to simulate a burning camp fire and is at least translucent to permit at least some of the light rays from the lightbulb 146 to pass therethrough to simulate flames for the fire. A cooking grill having frame pieces 162 and cross pieces 164 is provided spanning the cover member 160 and positioned thereabove by post members 166. The post members 166 have base plates 168 which are positionable on top of the support base 136 between pairs of spaced apart simulated rocks 156 on diametric opposite sides of the base 136. The frame pieces 162 and cross pieces 164 may be utilized as in FIG. 11 to provide a grate-type grill, or a pair of flat grill plates 170 (FIG. 1) may be positioned on top of and mate with the marginal edge of the pieces 162 and 164.

FIG. 10 shows the toy hatchet or axe 50 which is convertible to means for imprinting markings in the ground or the like. More particularly, a hatchet-like member is provided with an edged head portion 172 mounted on one end of an elongated handle portion 174. An imprint member, generally designated 176, has a plate portion 178 with imprint protrusions 180 on the front face thereof for imprinting markings in the ground. As can be seen from FIG. 10, the imprint protrusions 180 are formed in the shape of an animal's paw. Of course, many other markings such as a bird's foot or any other imprint is contemplated by the invention.

A pair of grooves 182 are formed on opposite sides of the edged head portion 172 of the hatchet for receiving inwardly directed tongue portions 184 formed on the ends of flanges 186 which are secured to the back of the plate member 178 of the imprint member 176. The grooves 182 slidably receive the tongues 184 for removably mounting the imprint member 176 onto the head portion 172 of the hatchet covering at least a part of the edge 188 thereof.

Figure 9:
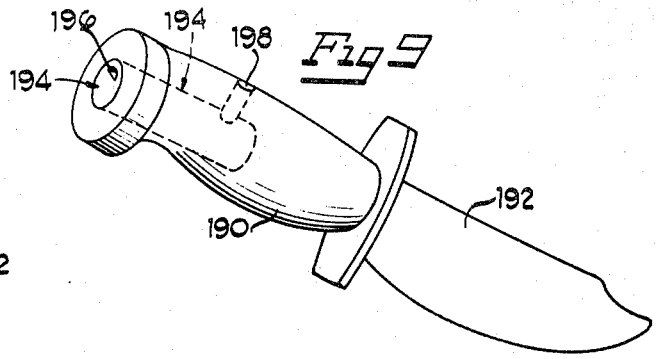
FIG. 9 is a perspective view of the combination knife and animal call of the present invention.

FIG. 9 shows a combination knife and sound means which includes a knife having a handle portion 190 and a blade portion 192. An air actuatable sound producing device, generally designated 194, is imbedded in the handle portion 190 for rendering an audible sound in response to a user blowing therethrough. More particularly, the sound producing device 194 is in the form of a whistle for producing a sound, such as an animal call, and has an intake aperture 196 in the end of the handle portion 190 through which a user may blow and an exhaust aperture 198 on the side of the handle portion 190 through which the air produced sound is emitted.

Figure 15:
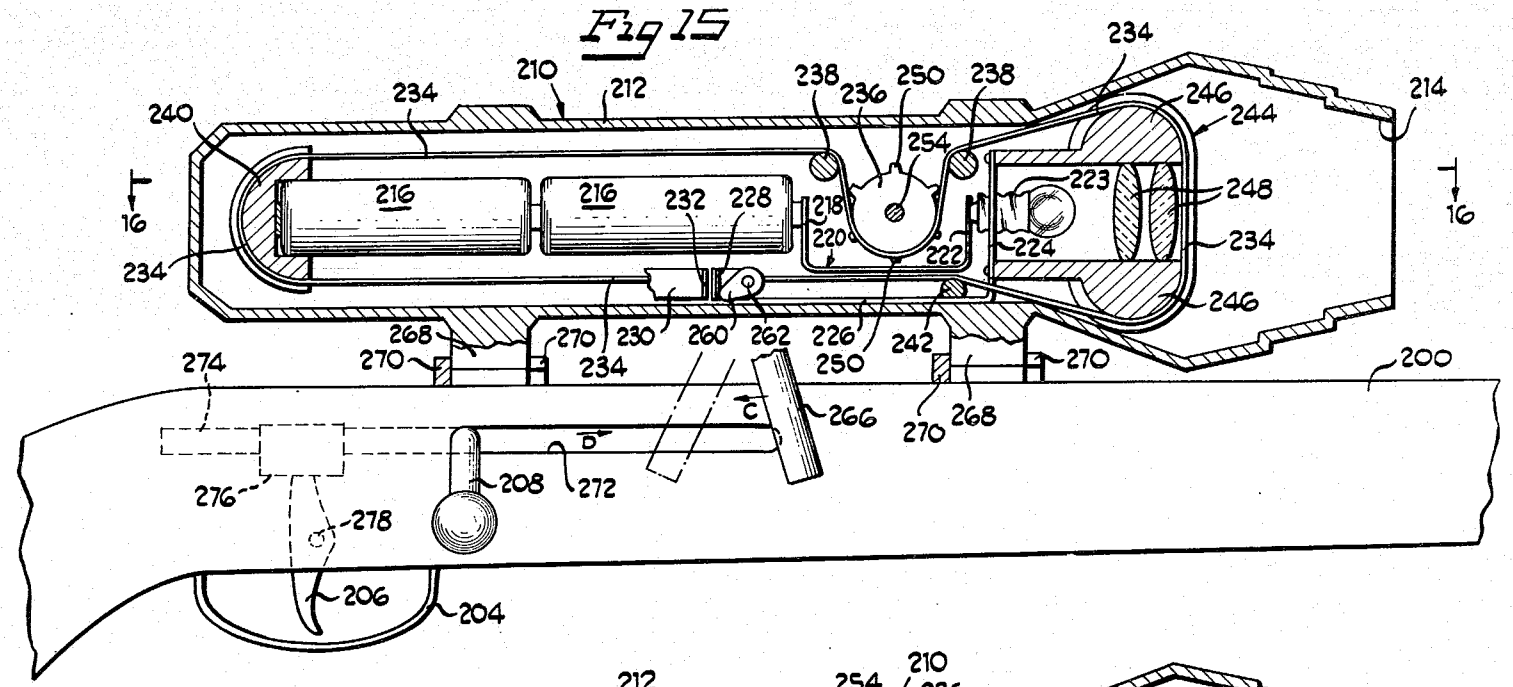
FIG. 15 is a front to rear vertical section through the light projecting scope means and gun combination of the present invention.
Figure 16:
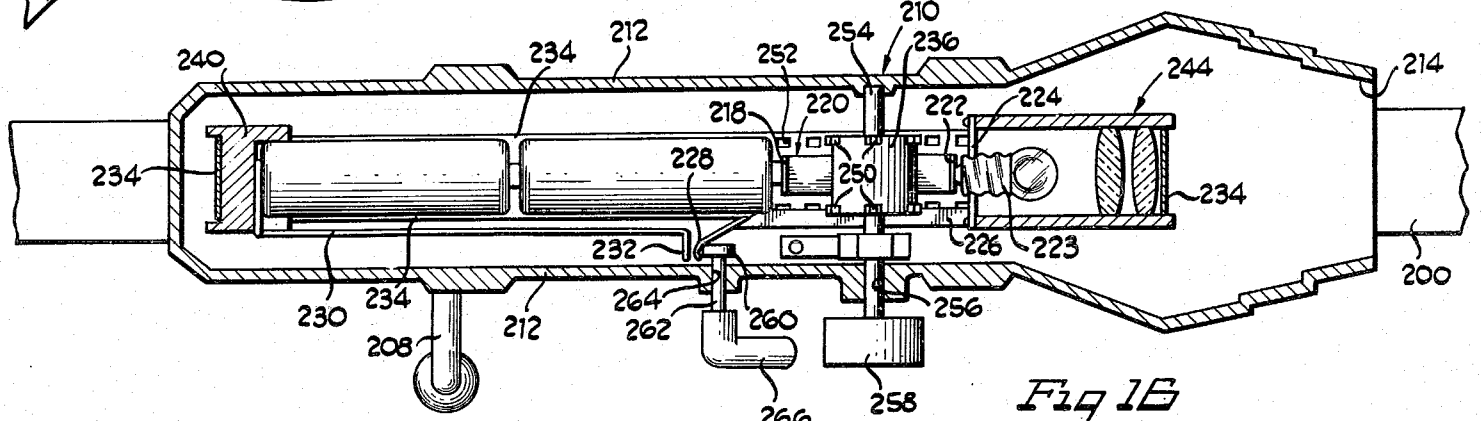
FIG. 16 is a horizontal section taken generally along the line 16—16 of FIG. 15.

FIGS. 15 and 16 show the simulated scope means and part of the gun of the scope and gun combination 38 shown in FIG. 1. Referring first back to FIG. 1, the gun is of the rifle type having a stock portion 200, a barrel 202, a trigger housing 204, a trigger 206, and a bolt 208. The scope means is generally designated 210 in FIGS. 1, 15 and 16 and includes a substantially hollow housing 212 which has an open front end 214. In essence, the scope means 210 is formed substantially as a flashlight construction and has a pair of batteries 216 mounted on the inside thereof, the front end of the forwardmost battery is in engagement with one leg 218 of a generally U-shaped conductive bracket, generally designated 220. The opposite leg 222 of the conductive bracket is in engagement with the base of a lightbulb 223. The lightbulb, in turn, is threaded into a conductive plate 224 which is secured to an elongated conductor strip 226. A movable resilient spring leaf switch contact 228 is mounted on the rear end of the conductor strip 226. In order to complete the circuit, an elongated L-shaped conductor member 230 has a fixed switch contact portion 232 adjacent the movable switch contact 228 and is in engagement with the rear end of the rear battery 216. Thus, the switch contacts 228, 232 can be closed and opened to energize and de-energize the scope means as is done with a standard flashlight construction. The operation of the switch will be described hereinafter.

Means is provided within the scope 210 for projecting images therefrom by utilizing the light rays from the lightbulb 223. More particularly, a continuous irregularly looped film strip 234 is wrapped about a sprocket wheel 236 and a pair of adjacent guide rollers 238. The film proceeds toward the rear of the scope housing 212 and is guided about a semicircularly shaped boss 240. The film proceeds back toward the front of the scope housing 212 past a guide roller 242 and about a lens housing, generally designated 244, having a pair of rounded portions 246 for guiding the film past a pair of lens member 248 disposed between the film and the lightbulb 223.

In order to advance the film 234 past the front of the lens members 248, the sprocket wheel 236 has a plurality of sprockets 250 engageable within apertures 252 of the film in customary manner. The sprocket wheel is fixed to a shaft 254 which s journalled in the housing 212 and which protrudes through an aperture 256. A film advance knob 258 is fixed to the shaft 154 on one side of the outside of the housing. Manual rotation of the knob 258 rotates the sprocket wheel 236 to thereby advance the film past the front of the lens members 248. The switch contacts 228 and 232 are moved into engagement by means of a cam member 260 disposed on one end of a shaft 262 within the housing 212. The shaft protrudes through an aperture 264 in the housing and has a downwardly depending arm 266 fixed thereto. In order to close the switch, the arm 266 is moved in the direction of arrow C (FIG. 15) to bias the cam 260 into engagement with the resilient contact leaf 228 to move the same into engagement with the fixed switch contact 232. When the arm 266 is moved back to the position shown in FIGS. 15 and 16, the contact leaf 228 will move out of engagement with the fixed contact 232.

The stimulated scope 210 is removably mounted on top of the gun stock 200 by means of a pair of downwardly depending bosses 268 on the underside of the housing 212 which are slide fit between two pairs of flanges 270 on top of the gun stock 200.

The switch actuating arm 266 is positioned in the path of movement of the bolt 208 of the gun to provide means for automatically opening the switch in response to pulling back on the trigger 206. More particularly, the bolt 208 protrudes through an elongated slot 272 extending longitudinally along the side of the gun stock 200 and is movable to a rear cocked position at the rear of the slot 272 as shown in FIG. 15. In this position, a rearward extension 274 of the bolt 208 is held by a trip mechanism 276 operatively associated with the trigger 206 which may be pivoted by a pin 278. The trip mechanism 276 is shown in block form so as to encompass any variety of cocking and release mechanism for toy guns. One such mechanism employs a ratchet and pawl type construction where one or more ratchet teeth are provided on the bolt extension 274 engageable by a portion of the trigger 206 on the opposite side of a pivot pin 278, to define a pawl for cocking and holding the bolt in a rearward position. The bolt is spring loaded by a coil spring or other resilient means to urge the same forwardly in the direction of arrow D when the trigger is pulled to move its extension out of engagement with the bolt extension. When the bolt 208 moves forwardly in the slot 272 it will engage or strike the arm 266 and move the same back to the position shown in FIGS. 15 and 16 to open the contacts 228 and 232 to shut out the light 222. In other words, as a child aims the gun toward the image projected by the scope 210, as soon as he pulls the trigger 206 the image will disappear.

The film 234 within the scope 210 is intended to have a plurality of frames thereon for providing changeable images. For instance, the image of a big game animal may be shown advancing or running toward the child in sequential image frames whereupon when the child pulls the trigger to kill the animal the last image will disappear as the light goes out.

Figure 7:
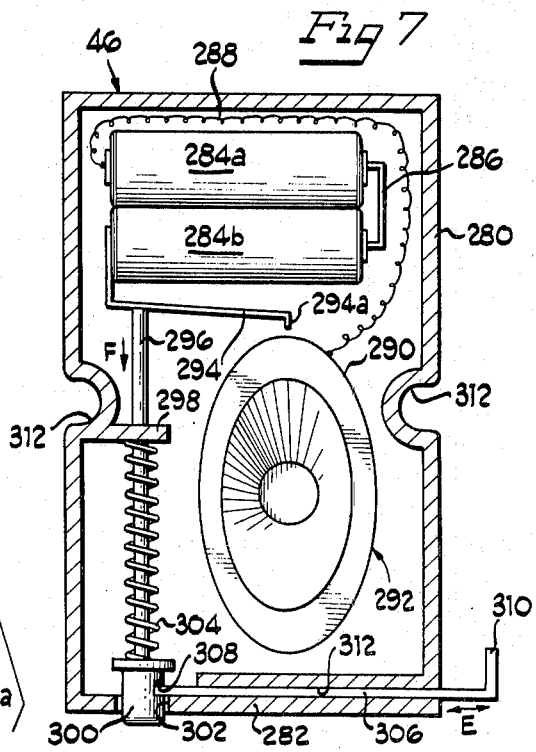
FIG. 7 is a vertical section through the warning device of the present invention.

The toy warning device 46 is shown in detail in FIG. 7 and includes an upright housing 280 having a base wall 282 for supporting the housing in an upright condition on a subjacent surface such as the ground, a floor, or the like. Actuatable signal means is mounted within the housing for rendering a signal when the housing is positionably disturbed to cause the base to move out of engagement with the subjacent surface as by tilting or lifting the housing. More particularly, a pair of batteries **284*a* and 284*b* are mounted within the housing, with adjacent ends thereof connected by a conductive bracket 286. The other end of battery 284*a* is connected by a wire 288 to a ring contact 290 of a speaker or buzzer device, generally designated 292. The adjacent end of the other battery 284*b* has a resilient leaf contact 294 secured thereto. The leaf contact 294 is generally L-shaped and has a movable switch contact portion 294*a* on the free end thereof in position for engagement with the ring contact 290 to close a circuit through the buzzer and the batteries 284*a*, 284*b*** to actuate the buzzer.

In order to actuate the buzzer 292 in response to lifting the base wall 282 off of its supporting surface, a plunger 296 is reciprocally journalled in a flange 298 within the housing 280 and has a button portion 300 on the lower end thereof which is reciprocal through an aperture 302 in the base wall 282 of the housing. A coil spring 304 is wrapped around the plunger 296 and is sandwiched between the flange 298 and the button 300 to bias the button and plunger downwardly. The button and plunger may be held upwardly by means of a conditioning arm 306 which has an inner end receivable in a notch 308 on the side of the button 300. The opposite end of the conditioning arm 306 protrudes outwardly through the housing and has a manually graspable flange 310 thereon. The conditioning arm is reciprocally received within an elongated hole 312 in the base wall 282 for movement back and forth in the direction of double-headed arrow E.

In operation of the warning device 46, it should be noted that the resilient spring contact 294 is biased toward the ring contact 290 for engagement therewith. However, when the plunger 296 is in its retracted position and held there at by the conditioning arm 306 being disposed in the notch 208 of the plunger button 300, the resilient contact 294 is held out of engagement with the contact 290. When the conditioning arm 306 is pulled manually outwardly, the plunger 296 will move downwardly in the direction of arrow F so that a circuit is closed through the contacts 294 and 290 to actuate the buzzer 292. Thus, it will be apparent that by pulling out on the conditioning arm 306 and then placing the warning device with the base wall 282 onto the ground, a floor, or the like, the button 300 will engage the ground and force the plunger 296 upwardly opposite the direction of arrow F to open the switch. Should a "stranger" or animal prowl about the camping area and knock the warning device over, the spring 304 will urge the plunger in the direction of arrow F and permit the resilient contact 294 to close the circuit and actuate the warning buzzer. Of course, the spring 304 should have a biasing force small enough that the weight of the warning device will bias the plunger upwardly against the force of the spring.

In order to extend the protective range of the warning device 46, a peripheral notch 312 is formed on the outside of the housing 280 so that a string 52 (FIG. 1) can be tied thereon. The opposite end of the string then can be tied to any structure spaced from the warning device, such as a tree, or, as shown in FIG. 1, one of the other camping devices such as the pack 48, whereby the warning device may be actuated by a person or animal stepping or tripping on the string 52.

FIGS. 3 and 4 show full top to bottom sectional views of the camping pack 48 and illustrate two of the features of the pack. Before going into the details of the features, it should be pointed out that the pack is fabricated of relatively rigid materials providing a framework which defines various compartments, interior cavities and the like. For instance, (including reference to FIGS. 1 and 2) the pack has a pair of side walls 314 and 316, a bottom wall 318 and interior walls 320, 322 (FIG. 1), and 324 (FIG. 1) defining storage compartments for various supplies as well as certain of the devices heretofore described. For instance, with reference to FIG. 2, the cooking utensils 42 and 44 are shown in a lower compartment, the warning device 46 is shown in the upper righthand compartment and various other miscellaneous items, generally designated 326 and 328 in the lower righthand compartment. In addition, a drawer, generally designated 330 is received within an interior recess defined by upper and lower walls 332 and 334 (FIGS. 3 and 4), respectively. The pack also has a rear wall 336 as well as a pair of front to rear extending flange-like supporting feet 338. FIG. 1 further shows a pair of flashlights 340 and a rope 342 received in the upper lefthand compartment of the pack.

Turning now to FIG. 3, the pack has an elongated periscope device, generally designated 344, which is in the form of a vertically extending generally rectangular tube having front and rear walls 346 and 348, respectively, and side walls 350. Top and bottom walls 352 and 354, respectively, close the tube. In customary fashion, an aperture 356 is formed at the top of the periscope, in this instance at the top of the rear wall 348 in registry with a canted mirror 358 which reflects light and/or images downwardly through the tubular periscope. A viewing aperture 360 is formed at the lower end of the periscope, in front wall 346, in registry with a second reflecting mirror 362 which is parallel to the mirror 358 to reflect the same image through aperture 360 as is defined by the image light rays entering aperture 356 onto mirror 358.

The periscope 344 is mounted within a complementary shaft type receptable 364 in the pack and is movable between a retracted position as shown in FIG. 3 substantially within the pack, to an upper position protruding substantially above the pack with the viewing aperture 360 is registry with a generally horizontally oriented viewing tube, generally designated 366. The viewing tube also is shown in FIGS. 1 and 2.

In order to facilitate movement of the periscope up and down relative to the pack, a rack and pinion mechanism is provided with a gear type rack 368 formed on the front of the periscope, facing inwardly as best seen in FIGS. 2 and 3. A pinion gear 370 is mounted on the inner end of a shaft 372 in position in mesh with the gear rack 368. The shaft 372 is journalled in and extends through a boss 374 and has a manually rotatable knob 376 exposed on the front of the pack as shown in FIGS. 1 through 3. Thus, it is apparent that a user simply rotates the knob 376 until the periscope is moved to a position with the viewing aperture 360 is registry with the viewing tube 366. This can be readily observed by the user from the front of the pack. Of course, the periscope is returned to its retracted position by rotating the knob in an opposite direction. FIGS. 4 and 5 show air pump means mounted on the frame for delivering air under pressure to inflate devices such as the air mattress 22 and the inflatable tent 20 (FIG. 1). More particularly, with reference to FIG. 4, a piston and cylinder type pump, generally designated 378, is mounted within the pack between rear wall 336 and an interior wall portion 380. The cylinder is formed by top, bottom and side walls 382, 384 and 386, respectively. A piston, generally designated 388, is reciprocally positioned within the cylinder on the upper end of a piston rod 390 which extends through an aperture 392 in the cylinder bottom wall 384 and an aperture 394 in the pack wall 332. An air exhaust tube 396 extends through the cylinder top wall 382 so as to be in communication with the interior-top of the cylinder, and the exhaust tube extends outwardly through an aperture 398 in the rear wall 336 of the pack. A first flap-type check valve 400 is positioned over an aperture 402 in the piston 388, and a second flap-type check valve 404 is positioned over an aperture 406 in the bottom wall 384 of the cylinder.

Thus, as the piston moves downwardly in the direction of arrow H, the air which was within the cylinder on the underside of the piston will be forced through the piston aperture 402 past the check valve 400 to the top of the piston, while the check valve 404 prevents the air from passing back through the cylinder aperture 406. When the piston 388 moves back upwardly in the direction of arrow I, the check valve 400 blocks the aperture 402 so that the piston forces the air in the top of the cylinder out through the exhaust tube 396 to fill an inflatable device, while at the same time air is drawn upwardly through the cylinder aperture 406 past the check valve 404 to fill the cylinder below the piston.

In order to oscillate the piston 388 within the cylinder 378, an eccentric crank means, generally designated 408 (FIG. 4) is provided. More particularly, a generally flat plate member 410 is mounted to a rectangular shaft 412, with the plate member 410 on the rear of the camping pack and the shaft 412 extending through an aperture 414 into the interior of the pack. An arm member 416 is fixed to the shaft 412 for rotation therewith in response to rotating the plate 410. The arm has an eccentric pin 418 spaced from the shaft 412 and journalled in an aperture 420 at the lower end of the piston rod 390. Thus, as the plate 410 is rotated on the rear of the pack, the eccentric pin 418 moves in a circle to oscillate the piston 488 up and down.

In order to accommodate the sideways movement of the piston rod 390, the upper end of the piston rod has a transverse tubular portion 422 which is pivoted by a rod 424 on the underside of the piston within a recess 426. In addition, the aperture 394 in the pack wall 332 is enlarged particularly in a direction perpendicular to the drawing. However, the aperture 392 should be sufficiently snug about the piston rod to prevent the passage therethrough of any substantial air on the piston's down stroke. As an alternate remedy the aperture 420 at the bottom of the piston rod may be elongated sideways in a direction perpendicular to the drawing to provide sideways lost motion relative to the pin 418. An interior pack wall 428 is provided in front of the eccentric means to prevent interference of the movement thereof by supplies or other items placed in the compartment in front thereof.

In order to rotate the plate 410 to oscillate the piston, a handle member, generally designated 430, is hinged as at 432 (FIG. 5) to the front of the plate 410. The handle has wing portions 434 to facilitate grasping thereof. In addition, the handle is pivoted to a shaft member 436 secured to the center hinge piece to permit the handle to be held and rotated in a circular path while the handle itself rotates relative to the plate 410 about an axis perpendicular thereto. The handle is movable from the position shown in FIGS. 4 and 5 generally flush with the plate 410, to an outwardly protruding position for easy manual manipulation.

It should be pointed out that depending on the type of inflatable device with which the pump means is to be used, an additional check valve might have to be provided on the outer end of the exhaust tube 396 to prevent the air from being drawn back into the cylinder from the device on the down stroke of the piston. Many inflatable air mattresses and the like are provided with their own check valve at the air entrance thereof and the openended tube 396, as shown, would be satisfactory. However, a check valve at the end of the tube is contemplated by the present invention. In addition, should an extension of the tube 396 be desirable, a flexible plastic or rubber tube could be positioned on the outside end thereof. In this regard, inwardly directed flanges 438 are provided about the periphery of the plate 310 within which a flexible tubular extension may be stored. Furthermore, since the flanges 438 and the handle 430 protrude outwardly from the plate 410, the entire mechanism 408 is mounted on a rear wall portion 440 which is sufficiently recessed that the various components do not protrude from the rear of the pack. This is particularly important when the pack is being used as a back pack. Although back straps are not shown in the drawings they are contemplated by the invention.

Figure 8:
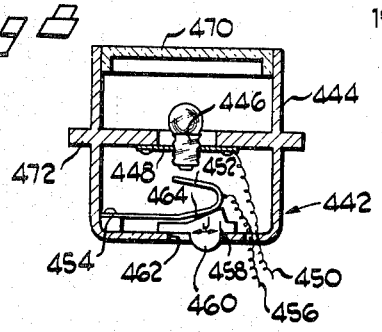
FIG. 8 is a front to rear central section through the signal and map light means of the present invention.

Referring to FIG. 8, a light means, generally designated 442, is mounted on the pack for various purposes such as facilitating visual observation and manipulation of the various devices on the pack when the lighting is poor. More particularly, a storage recess (not shown) is provided in the front of the pack substantially the same as the periscope viewing tube 366 and positioned directly therebelow. The lighting means 442 has a housing 444 of a size and shape to fit into either its storage recess or into the periscope viewing tube. When positioned in the periscope viewing tube, the light is relected off of the lower periscope mirror 362 through the periscope and out the upper aperture 356 to provide a light signal means. The light also may be used to read maps or the like, as described hereinafter.

The structure of the light means 442 includes a lightbulb 446 having the base thereof threaded into an aperture in a conductive mounting plate 448 which has a wire 450 connected thereto. A resilient switch contact 452 is mounted to the inside of the housing 444, as at 454. The switch contact 452 has a wire 456 connected thereto. A switch actuator 458 has a button portion 460 which protrudes through an aperture 462 in the front of the housing 444 for manual manipulation in the direction of doubleheaded arrow J. The switch actuator 458 has a canted cam surface 464 for engaging the switch contact 452 and biasing the same into engagement with the base of the lightbulb 446 to energize the same by establishing a circuit through the wires 450 and 456. In other words, as the switch actuator 458 is moved to the left as viewed in FIG. 8, the cam surface 464 will bias the switch contact against the lightbulb. The wires 450 and 456 are connected to a battery bracket 466 (FIG. 6) which is in conductive engagement with a battery 468 mounted on the pack. The light means 442 also also has a removable front light transmitting shield 470. The housing 444 has flanges 472 which abut against the front of the pack when positioned in its own storage recess or in the periscope viewing tube 366.

Figure 6:
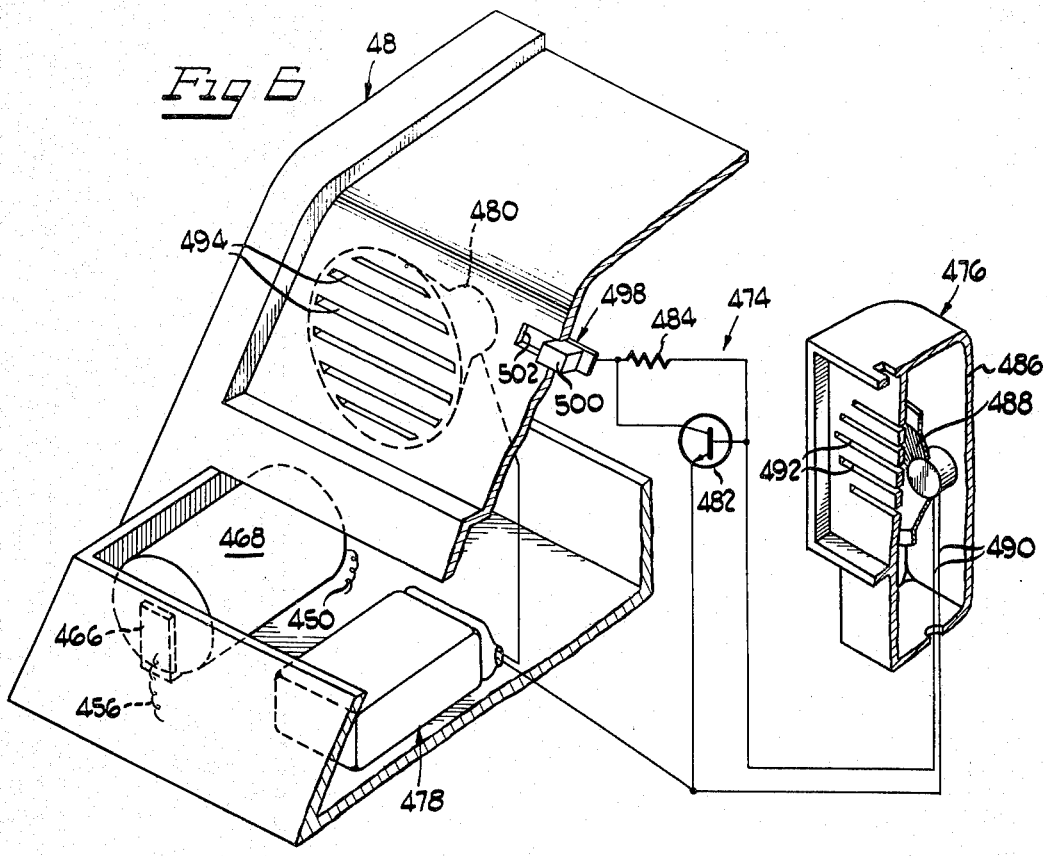
FIG. 6 is a perspective view, partially broken away, of the amplification device mounted on the camping pack.

A sound amplification unit as best seen in FIGS. 2 and 6 also is provided on the camping pack 48. More particularly, a transistorized amplifier, generally designated 474 (FIG. 6), is connected between a microphone, generally designated 476, a power source, generally designated 478, and a speaker, generally designated 480 (also see FIG. 4). The amplifier is known in the art and includes a diode 482 and a resistor 484. The microphone includes a housing 486 having a diaphragm receiver 488 connected in the circuit by wires 490. Slots 492 are provided in the housing in front of the diaphragm for the passage of sound waves therethrough. A high impedance crystal microphone has proved to be satisfactory. As seen in FIGS. 1 and 2, the microphone preferably is mounted on the end of an elongated cord 496 so that the microphone may be utilized at a position remote from the pack. The power source 478 is a battery type power source and a nine volt transistor radio battery could be used. The speaker 480 has a diaphragm disposed behind a plurality of slits 494 in the pack housing for the transmission of sound waves therethrough. An on-off switch, generally designated 498 also is provided in circuit with the microphone, amplifier and speaker and includes a switch button 500 reciprocally mounted within a slot 502 on the front of the pack housing so that the switch can be manipulated from the outside of the pack. A mesh screen 504 (FIG. 2) may be provided to cover the slots 490 of the speaker, if desired. A dummy control knob 505 is provided on the front of the pack.

As seen best in FIGS. 1 and 2, the pack has means on the sides thereof for removably holding various tools or implements such as the hatchet 50. A pair of holders 506 are provided on one side of the pack in vertical alignment and through which the handle portion 174 of the hatchet may be positioned. A similar holder 508 is disposed on the opposite side of the pack for holding a standard foldable shovel with the handle portion 510 of the shovel positioned downwardly into the holder 508. A blade portion 512 of the shovel is pivoted, as at 514, to the top of the handle portion 510 whereupon the blade portion may be folded downwardly on the outside of the holder 508. An L-shaped bracket 516 also is provided on the same side of the pack in front of the holder 508 for receiving the foldable leg 518 of the chair 34 with the chair hanging downwardly therefrom.

In order to close the pack 48 so as to protect the interior components thereof and to hold the various items therein, the pack is provided with a top cover 520 (FIG. 1) and a front cover 522. The top cover is hinged to the top of the pack by means of a slot 524 in the cover which is positionable over a hook 526 (see FIGS. 2 and 4) on the top of the pack. By using the hook 526 and slot 524 arrangement, the cover is removable from the pack.

The front cover 522 has a pair of hooks 528 formed on the bottom edge thereof similar to the hook 526. The hooks 528 are received in elongated apertures or slots 530 (FIG. 3) in the bottom wall 318 of the pack. Thus, the hooks and apertures may be engaged and the cover lifted to close the pack, but the front cover may be removed for purposes described below. Appropriate latch means may be provided between the covers or between the covers and the pack to hold the covers in their closed positions.

As seen in FIG. 1, the front cover 522 of the pack has an inside surface which is substantially planar, and, preferably, the cover is fabricated of sufficient rigid material so as to support a map 532 or the like so that the map can be worked upon when the cover is opened or removed from the pack.

Referring back to FIG. 2, it can be seen that the warning device 46 is positionable in the upper right-hand compartment of the pack with the actuating button 300 protruding forwardly. Preferably, the height of the housing 280 of the warning device is substantially the same as the depth of the upper righthand compartment so that the button 300 can protrude outwardly therefrom. Thus, as the covers are closed to close the pack, the button 300 and thus the plunger 296 will bias the switch contact out of engagement. However, whenever the cover is opened, the spring 304 of the warning device will bias the button and plunger outwardly and effect a warning signal, as described above, to give an alert upon unauthorized tampering with the pack.

The inflatable tent 20 (FIG. 1) is formed by a plurality of tubes 534 which define side walls 536, a slanted top wall 538 and a slanted rear wall 540. A pair of triangular support flaps 542 are joined along two edges thereof to one of the side walls and the top wall at the front juncture thereof. One or more air valves 544 are provided to inflate the tent by means of the pump 378 on the pack 48.

The foregoing detailed description has been given for clearness for understanding only and no unnecessary limitations should be understood therefrom as some modifications will be obvious to those skilled in the art.

We claim:

1. A convertible flashlight lantern, comprising, in combination: a flashlight-type lighting construction unit including a self-contained, power source, a lamp, a reflector mounted on one end of said unit generally about said lamp for directing a beam of light therefrom in a generally singular direction, and switch means for connecting said lamp to said power source for illuminating the lamp, a lantern type conversion unit comprising an upwardly tapering lantern base portion and upwardly diverging light transmitting lantern shield mounted on said base portion, an upper lantern cap mounted on said shield, said cap including a generally cylindrical aperture therein to provide access to the interior of said shield, connecting means mounted on said cap for removably connecting and holding the flashlight unit with its beam of light directed generally toward the center of the base portion, diffusion means mounted on said base portion in the path of said beam of light from the flashlight unit when the flashlight unit is connected to said cap by said connecting means for reflecting the light outwardly from the conversion unit in plural directions through said shield, and at least one removable, generally tubular, at least translucent lens member mounted on said one end of the flashlight unit for surrounding said diffusion means when the flashlight unit is connected by said connection means to said lantern cap and including a loop-type handle pivotally mounted to said lantern cap and protruding upwardly beyond the top of said flashlight when connected by said connection means.

2. The combination of claim 1 wherein said diffusion means comprises a conical reflector disposed in the path of said beam of light with the apex of the cone facing the flashlight so as to radiate the light outwardly 360°.

3. The combination of claim 2 wherein said connecting means and said flashlight have complementarily engaging surface means for holding the flashlight in position to direct the beam of light in a generally vertical direction so that said conical reflector reflects the light outwardly in a generally horizontal direction.

* * * * *